US005716307A

United States Patent [19]

Vadher

[11] Patent Number: 5,716,307

[45] Date of Patent: Feb. 10, 1998

[54] BODY EXERCISE DEVICE

[76] Inventor: Dinesh L. Vadher, 20 Alta Vista, Belle Terre, N.Y. 11777

[21] Appl. No.: 676,471

[22] Filed: Jul. 8, 1996

[51] Int. Cl.[6] ..... A63B 21/02

[52] U.S. Cl. ..... 482/125; 482/124

[58] Field of Search ..... 482/121, 124, 482/125, 79

[56] References Cited

U.S. PATENT DOCUMENTS

| | | | |
|---|---|---|---|
| 2,613,932 | 10/1952 | Manners | 482/124 |
| 4,186,920 | 2/1980 | Fiore et al. | 482/79 |
| 4,728,103 | 3/1988 | Fulton | 482/125 |
| 5,186,701 | 2/1993 | Wilkinson | 482/124 |

*Primary Examiner*—Lynne A. Reichard

[57] ABSTRACT

A body exercise device that includes a right member for vertically encircling the right side of the exerciser, right shoulder engaging apparatus for selectively maintaining the right member against the right shoulder of the exerciser, right waist engaging apparatus for selectively maintaining the right member against the waist of the exerciser, right knee engaging apparatus for selectively maintaining the right member against the right knee of the exerciser, right foot engaging apparatus for selectively maintaining the right member against the right foot of the exerciser, a right sole assembly positionable on the right sole of the exerciser, a left member for vertically encircling the left side of the exerciser, left shoulder engaging apparatus for selectively maintaining the left member against the left shoulder of the exerciser, left waist engaging apparatus for selectively maintaining the left member against the waist of the exerciser, left knee engaging apparatus for selectively maintaining the left member against the left knee of the exerciser, left foot engaging apparatus for selectively maintaining the left member against the left foot of the exerciser, and a left sole assembly positionable on the left sole of the exerciser.

22 Claims, 5 Drawing Sheets

BODY EXERCISE DEVICE

BACKGROUND OF THE INVENTION

1. Field of the Invention

The present invention relates to a body exercise device. More particularly, the present invention relates to a body exercise device that includes a right member for vertically encircling the right side of the exerciser, right shoulder engaging apparatus for selectively maintaining the right member against the right shoulder of the exerciser, right waist engaging apparatus for selectively maintaining the right member against the waist of the exerciser, right knee engaging apparatus for selectively maintaining the right member against the right knee of the exerciser, right foot engaging apparatus for selectively maintaining the right member against the right foot of the exerciser, a right sole assembly positionable on the right sole of the exerciser, a left member for vertically encircling the left side of the exerciser, left shoulder engaging apparatus for selectively maintaining the left member against the left shoulder of the exerciser, left waist engaging apparatus for selectively maintaining the left member against the waist of the exerciser, left knee engaging apparatus for selectively maintaining the left member against the left knee of the exerciser, left foot engaging apparatus for selectively maintaining the left member against the left foot of the exerciser, and a left sole assembly positionable on the left sole of the exerciser.

2. Description of the Prior Art

Physical fitness is recognized as essential to good health and longevity. For example, one of the leading causes of death in the United States is heart disease.

Modern people increasingly find themselves working at jobs which are sedentary or which require less and less physical exercise. As a consequence, in order to maintain physical fitness, many people turn to fitness centers, aerobic exercises, and other forms of recreational activity to develop or maintain good physical condition of their bodies.

Fitness centers typically include a variety of equipment on which the members perform various exercises for developing the muscle tone and building muscles in different parts of their bodies. There are rowing machines, stair climbing machines, treadmills, weight lifting machines in a wide variety of configurations. Machines of this type, however, are relatively bulky, and for that reason, generally are found only in commercial fitness centers.

Machines are sold for home use, but each machine requires substantial storage space in the home. Frequently, any given machine is capable only of exercising some, but not all, of the muscles in a person's body.

Aerobic exercise, is an important element in achieving and maintaining physical fitness. Numerous studies have shown that consistent aerobic exercise will significantly reduce the risk factors associated with heart disease.

Aerobic exercise is available through many sports and activities, each with certain advantages and limitations. Cross-country skiing has long been regarded by fitness experts as one of the best overall aerobic activities because it is a total body endurance sport that aerobically conditions both the upper and lower body.

Unfortunately, only a relatively small number of people have access to cross-country ski areas, and the sport is, of course, subject to season and weather. There are cross-country ski simulators, but those currently available require a high level of skill to use, are expensive, and provide resistance through a limited range of motion which reduces the effectiveness of the activity.

Other activities are more widely available. Currently, the most popular modes of aerobic exercise are walking, jogging, aerobic dance, stair-stepping, and stationary cycling. Although these activities are beneficial if performed regularly, they do little to aerobically condition or tone the muscles of the upper body.

In an effort to increase the effectiveness of such activities, some individuals have used hand-held weights. Several studies have shown, however, that hand-weights are ineffective in enhancing weight loss or significantly improving cardiovascular parameters. Further, because of the ballistic nature of the forces involved, hand weight users are more prone to shoulder injuries.

Numerous innovations for body exercise devices have been provided in the prior art that will be described. Even though these innovations may be suitable for the specific individual purposes to which they address, however, they differ from the present invention in that they do not teach a body exercise device that includes a right member for vertically encircling the right side of the exerciser, right shoulder engaging apparatus for selectively maintaining the right member against the right shoulder of the exerciser, right waist engaging apparatus for selectively maintaining the right member against the waist of the exerciser, right knee engaging apparatus for selectively maintaining the right member against the right knee of the exerciser, right foot engaging apparatus for selectively maintaining the right member against the right foot of the exerciser, a right sole assembly positionable on the right sole of the exerciser, a left member for vertically encircling the left side of the exerciser, left shoulder engaging apparatus for selectively maintaining the left member against the left shoulder of the exerciser, left waist engaging apparatus for selectively maintaining the left member against the waist of the exerciser, left knee engaging apparatus for selectively maintaining the left member against the left knee of the exerciser, left foot engaging apparatus for selectively maintaining the left member against the left foot of the exerciser, and a left sole assembly positionable on the left sole of the exerciser.

FOR EXAMPLE, U.S. Pat. No. 5,186,701 to Wilkinson teaches an aerobic exercise garment that includes an article of clothing worn on the body with an anchor member worn at the hand or foot. A connecting element is connected to the article of clothing and the anchor member. The connecting element is preferably made of an elastic material so as to offer resistance during the movement of the arm or leg in a motion exercise.

ANOTHER EXAMPLE, U.S. Pat. No. 5,203,754 to Maclean teaches a variable resistance leg harness exercise apparatus that includes a belt, leg attachments, foot attachments, and stretchable cords attached to the belt and to the leg, and foot attachments for enabling the user to perform under increased load while not changing the user's natural center of gravity and without distorting the natural patterns of the exercise being performed.

STILL ANOTHER EXAMPLE, U.S. Pat. No. 5,256,119 to Tudor teaches an exercise harness for restricting hyperextension of a wearer's legs when worn by the wearer in an upright position. The harness includes a waist belt with depending leg straps located against the back of the wearer's legs and connected to foot stirrups. The straps have knee bends to retain the straps against the legs and adjustment structure to adjust the length of the straps and the resulting degree of hyperextension of the wearer's legs.

YET ANOTHER EXAMPLE, U.S. Pat. No. 5,308,305 to Romney teaches an apparatus for augmenting exercise of body muscles that includes one or more articles of close-fitting wearing apparel employing one or more removable elongate resistance members, loosely enclosed in passageways along a portion of the length of the apparel. The resistance members are releasibly anchored at one end to a fixed-in-place member such as a belt or a shoulder harness and attached at the distal end to the extremity of an arm or leg. The apparatus is devised so as to increase the energy required by a user to flex his arms or legs over the energy level necessary without the resistance of the elongate resistance members.

STILL YET ANOTHER EXAMPLE, U.S. Pat. No. 5,336,151 to Van Ballegooie teaches a body exercise device that includes a waist belt which is releasibly fastened on the waist of a user. A plurality of snap rings are pivotally attached to the belt at spaced intervals throughout its length to provide different attachment locations for elongated elastic members. The elastic members have snap hooks connected at opposite ends, with one end of each elastic member connecting to a selected one of the snap rings on the belt. Foot pieces are provided for each foot of the user. Each of the foot pieces has a snap ring on it for attachment to a snap hook on the opposite end of an elastic member. Hand pieces also are provided for each hand and include a hand-encircling portion and a wrist protector portion with a swivel snap ring on them to which a snap hook on the opposite end of a corresponding elastic member is attached. The foot members also have swivel snap rings located on an ankle extending portion on the inside of each ankle for connection to an additional elastic member by means of snap hooks located on each end. Various exercises can be performed by the exercise device and different muscles may be exercised by connecting the elastic members to different ones of the snap rings on the waist encircling member, in accordance with the exercise to be performed.

YET STILL ANOTHER EXAMPLE, U.S. Pat. No. 5,357,637 to Moore teaches an elastic band attachable above the knees of the wearer to the sides of pants being worn. The elastic band has attachment devices secured to the elastic band which are fastened to attachment devices on the pants. As the wearer walks or cycles, the elastic band resistance is provided to the leg muscles and provides a form of aerobic exercise.

FINALLY, STILL YET ANOTHER EXAMPLE, U.S. Pat. No. 5,362,295 to Nurge teaches an exercise system which exercises the musculature of the upper body while simultaneously performing a lower body aerobic exercise. The system includes a belt, a variety of elastic cords, a variety of hand grips, ankle straps, and foot straps. Variable resistance is provided by an elastic cord which is free to slide about the user's waist. The elastic cords are provided with clip-hooks at each end which allow them to be easily attached to and detached from the belt and the straps. Additionally, a wrist attachment is disclosed.

It is apparent that numerous innovations for body exercise devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a body exercise device that avoids the disadvantages of the prior art.

ANOTHER OBJECT of the present invention is to provide a body exercise device that is simple and inexpensive to manufacture.

STILL ANOTHER OBJECT of the present invention is to provide a body exercise device that is simple to use.

BRIEFLY STATED, YET ANOTHER OBJECT of the present invention is to provide a body exercise device that includes a right member for vertically encircling the right side of the exerciser, right shoulder engaging apparatus for selectively maintaining the right member against the right shoulder of the exerciser, right waist engaging apparatus for selectively maintaining the right member against the waist of the exerciser, right knee engaging apparatus for selectively maintaining the right member against the right knee of the exerciser, right foot engaging apparatus for selectively maintaining the right member against the right foot of the exerciser, a right sole assembly positionable on the right sole of the exerciser, a left member for vertically encircling the left side of the exerciser, left shoulder engaging apparatus for selectively maintaining the left member against the left shoulder of the exerciser, left waist engaging apparatus for selectively maintaining the left member against the waist of the exerciser, left knee engaging apparatus for selectively maintaining the left member against the left knee of the exerciser, left foot engaging apparatus for selectively maintaining the left member against the left foot of the exerciser, and a left sole assembly positionable on the left sole of the exerciser.

The novel features which are considered characteristic of the present invention are set forth in the appended claims. The invention itself, however, both as to its construction and its method of operation, together with additional objects and advantages thereof, will be best understood from the following description of the specific embodiment when read and understood in connection with the accompanying drawing.

BRIEF DESCRIPTION OF THE DRAWING

The figures of the drawing are briefly described as follows.

DETAILED DESCRIPTION OF THE PREFERRED EMBODIMENT

Figure 1:
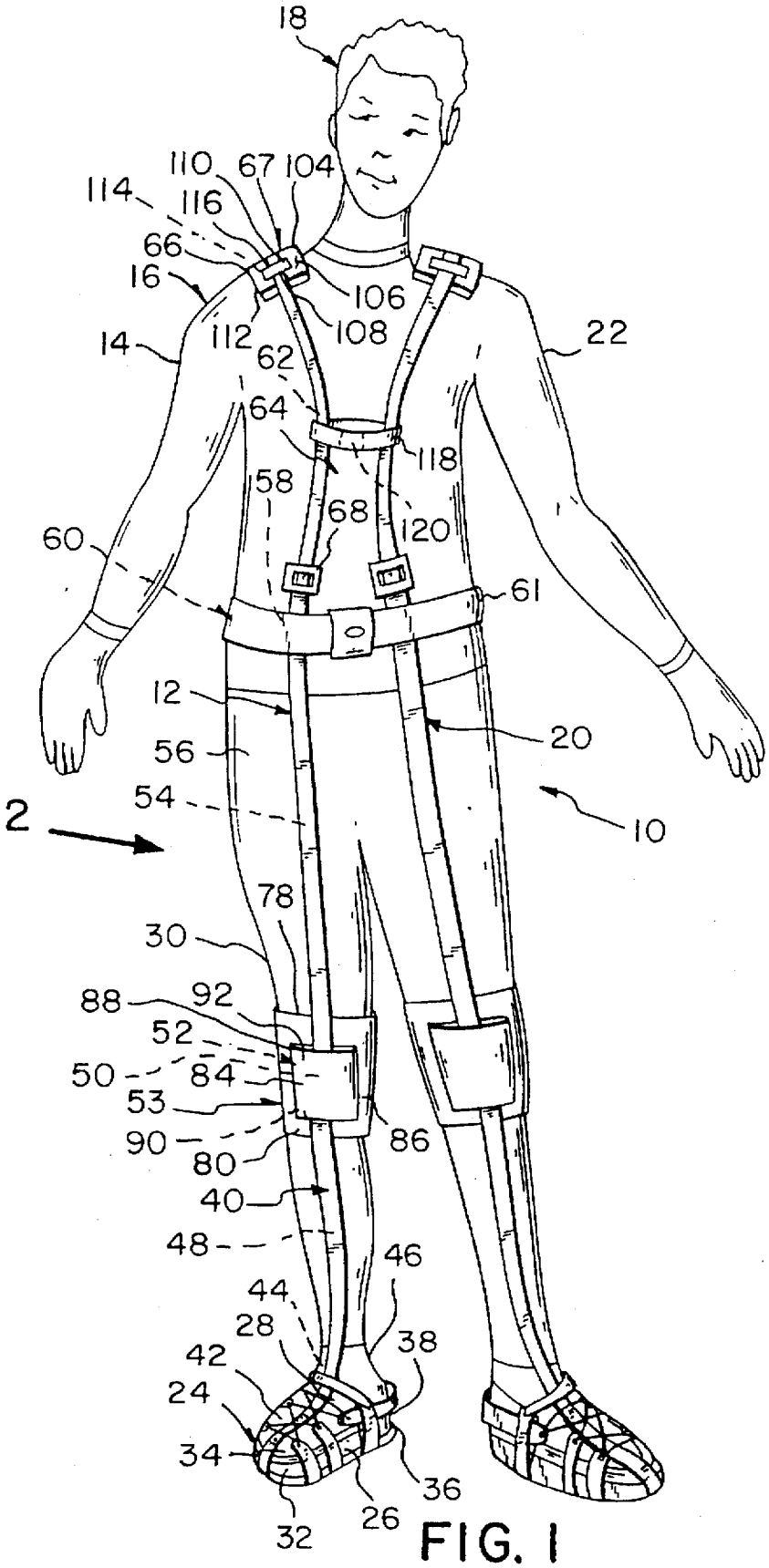
FIG. 1 is a diagrammatic front perspective view of the present invention donned by an exerciser.
Figure 2:
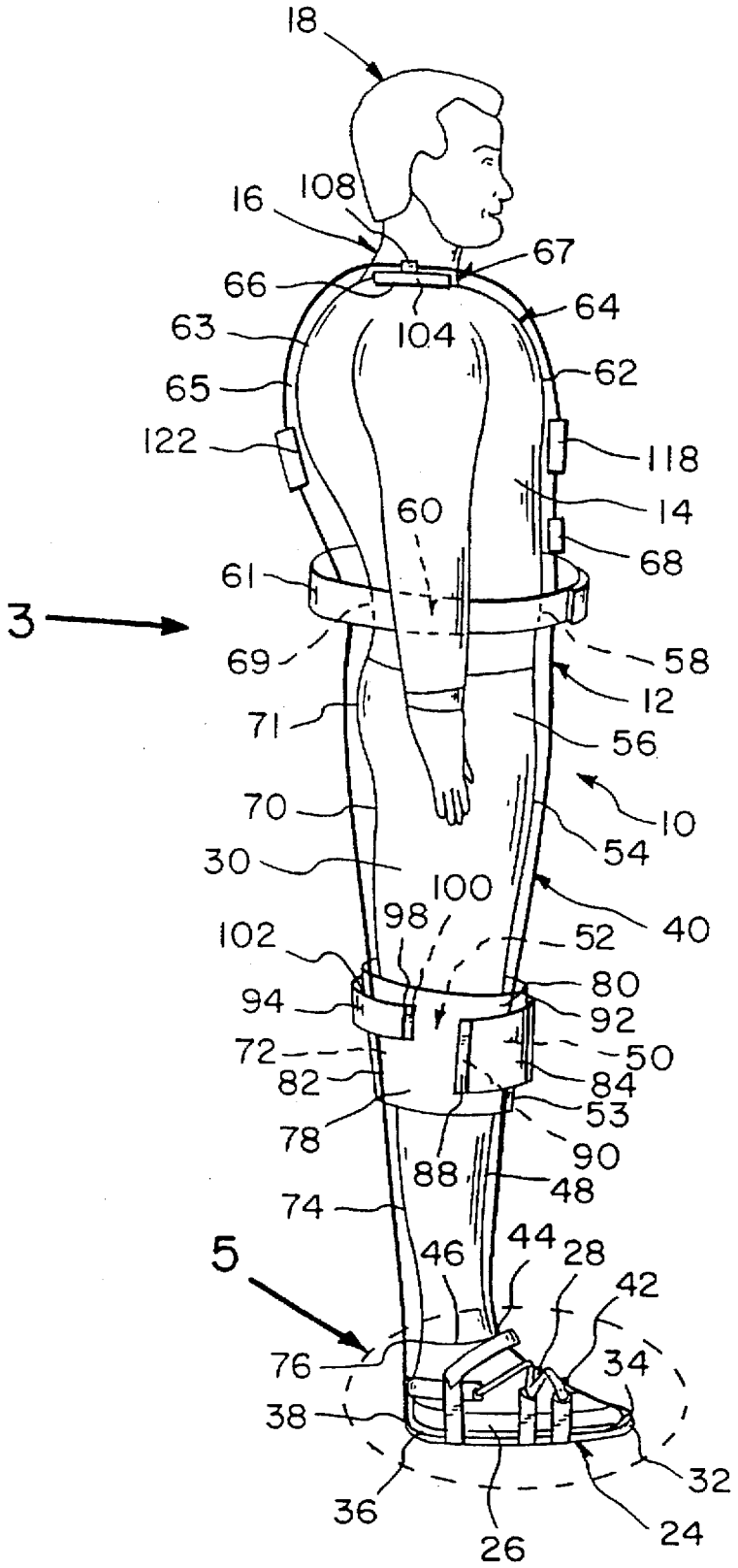
FIG. 2 is a diagrammatic side perspective view of the present invention donned by the exerciser, taken generally in the direction of ARROW 2 in FIG. 1.
Figure 3:
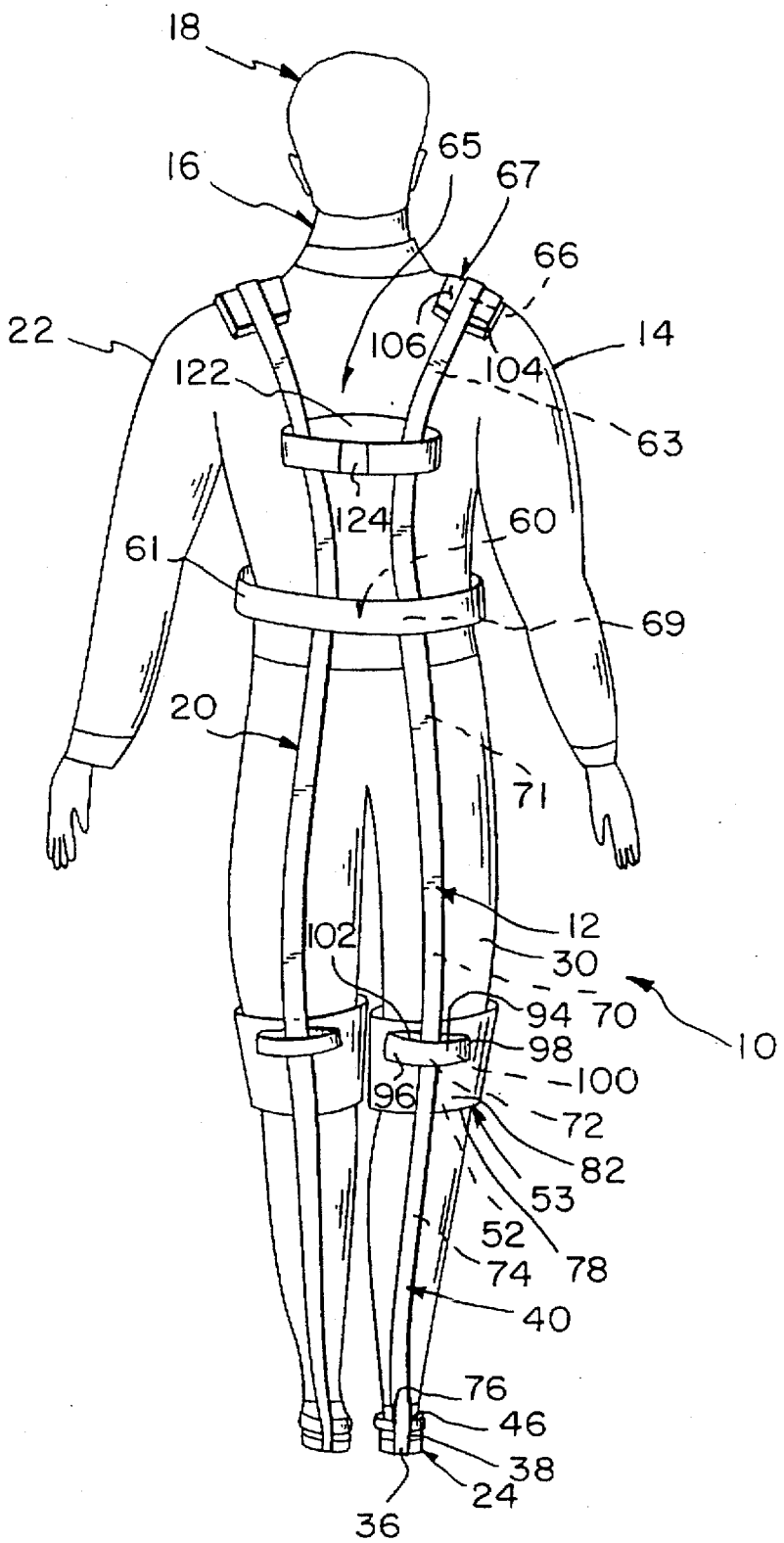
FIG. 3 is a diagrammatic rear perspective view of the present invention donned by the exerciser, taken generally in the direction of ARROW 3 in FIG. 2.

Referring now to the figures in which like numerals indicate like parts, and particularly to FIG. 1, FIG. 2, and FIG. 3, which are a diagrammatic front perspective view of the present invention donned by an exerciser, a diagrammatic side perspective view of the present invention donned by the exerciser, taken generally in the direction of ARROW 2 in FIG. 1, and a diagrammatic rear perspective view of the present invention donned by the exerciser, taken generally in the direction of ARROW 3 in FIG. 2, respectively, the body exercise device of the present invention is shown generally at 10 and includes a right side member 12 that is elastic, elongated, slender, and formed as a closed loop and vertically encircles an exerciser body right side 14 of an exerciser body 16 of an exerciser 18, and a left side member 20 that is elastic, elongated, slender, and formed as a closed loop and vertically encircles an exerciser body left side 22 of the exerciser body 16 of the exerciser 18.

The configuration of the right side member 12, and the left side member 20 can best be seen in FIG. 1, FIG. 2, and FIG. 3, which are a diagrammatic front perspective view of the present invention donned by an exerciser, a diagrammatic side perspective view of the present invention donned by the exerciser, taken generally in the direction of ARROW 2 in FIG. 1, and a diagrammatic rear perspective view of the present invention donned by the exerciser, taken generally in the direction of ARROW 3 in FIG. 2, respectively, and as such will be discussed with reference thereto.

It is to be understood, however, that since the configuration of the left side member 20 is identical to that of the right side member 12, for the sake of brevity, only the right side member 12 will be discussed.

The right side member 12 includes a right side member right foot sole assembly 214 that is positionable on an exerciser body right leg sole 26, i.e., inter alia, the general area of the Plantar Region, of the exerciser body right leg foot 28, i.e., inter alia, the general area of the Tarsus, of an exerciser body right leg 30 of the exerciser body right side 14 of the exerciser body 16 of the exerciser 18.

The right side member right foot sole assembly 24 of the right side member 12 has a right side member right foot sole assembly toe area 32 that is positionable under exerciser body right leg foot toes 34 of the exerciser body right leg foot 28 of the exerciser body right leg 30 of the exerciser body right side 14 of the exerciser body 16 of the exerciser 18, and a right side member right foot sole assembly heel area 36 that is positionable under an exerciser body right leg foot heel 38, i.e., inter alia, the general area of the Calcaneum or Os Calcis, of the exerciser body right leg foot 28 of the exerciser body right leg 30 of the exerciser body right side 14 of the exerciser body 16 of the exerciser 18.

The right side member 12 further includes a right side member strap 40 that is one-piece, continuous, elastic, elongated, and slender, and fixedly attached at one end thereof to, and extends continuously vertically upwardly from, the right side member right foot sole assembly toe area 32 of the right side member right foot sole assembly 24 of the right side member 12, continuously vertically upwardly along an exerciser body right leg foot instep 42, i.e., inter alia, the general area of the tarsal, of the exerciser body right leg foot 28 of the exerciser body right leg 30 of the exerciser body right side 14 of the exerciser body 16 of the exerciser 18, where it is selectively maintained thereagainst by the right side member right foot sole assembly 24 of the right side member 12, to an exerciser body right leg ankle anterior portion 44, i.e., inter alia, the general area of the Tibialis Anticus, of an exerciser body right leg ankle 46 of the exerciser body right leg 30 of the exerciser body right side 14 of the exerciser body 16 of the exerciser 18.

The right side member strap 40 of the right side member 12 further extends continuously vertically upwardly from the exerciser body right leg ankle anterior portion 44 of the exerciser body right leg ankle 46 of the exerciser body right leg 30 of the exerciser body right side 14 of the exerciser body 16 of the exerciser 18, continuously vertically upwardly along an exerciser body right leg shin 48, i.e., inter alia, the general area of the Tibia, of the exerciser body right leg 30 of the exerciser body right side 14 of the exerciser body 16 of the exerciser 18, to an exerciser body right leg knee anterior portion 50, i.e., inter alia, the general area of the Patella, of an exerciser body right leg knee 52 of the exerciser body right leg 30 of the exerciser body right side 14 of the exerciser body 16 of the exerciser 18, where it is selectively maintained thereagainst by a right side member knee maintaining apparatus 53.

The right side member strap 40 of the right side member 12 further extends continuously vertically upwardly from the exerciser body right leg knee anterior portion 50 of the exerciser body right leg knee 52 of the exerciser body right leg 30 of the exerciser body right side 14 of the exerciser body 16 of the exerciser 18, continuously vertically upwardly along an exerciser body right leg thigh anterior portion 54, i.e., inter alia, the general area of the Quadriceps Extensor, of an exerciser body right leg thigh 56 of the exerciser body right leg 30 of the exerciser body right side 14 of the exerciser body 16 of the exerciser 18, to an exerciser body waist right anterior portion 58, i.e., inter alia, the general area of the Poupart's Ligament, of an exerciser body waist 60 of the exerciser body 16 of the exerciser 18, where it is selectively maintained thereagainst by a waist belt 61 that adjustably and releasibly encircles the exerciser body waist 60 of the exerciser body 16 of the exerciser 18 and overlaps the right side member strap 40 of the right side member 12.

The right side member strap 40 of the right side member 12 further extends continuously vertically upwardly from the exerciser body waist right anterior portion 58 of the exerciser body waist 60 of the exerciser body 16 of the exerciser 18, continuously vertically upwardly along an exerciser body chest right breast 62, i.e., inter alia, the general area of the Pectoris Major, of an exerciser body chest 64, i.e., inter alia, the general area of the Anterior Thoracic Region, of the exerciser body 16 of the exerciser 18, to an exerciser body right shoulder 66, i.e., inter alia, the general area of the Clavicle, of the exerciser body 16 of the exerciser 18, where it is selectively maintained thereagainst by a right side member shoulder maintaining apparatus 67.

That portion of the right side member strap 40 of the right side member 12 that extends continuously vertically upwardly from the exerciser body waist right anterior portion 58 of the exerciser body waist 60 of the exerciser body 16 of the exerciser 18, continuously vertically upwardly along the exerciser body chest right breast 62 of the exerciser body chest 64 of the exerciser body 16 of the exerciser 18, to the exerciser body right shoulder 66 of the exerciser body 16 of the exerciser 18, has a right side member strap tension clip 68 disposed thereon, so that the length and the tension of the right side member strap 40 of the right side member 12 can be adjusted to the resistance preferred by the exerciser 18 and for the height thereof.

The right side member strap 40 of the right side member 12 further extends continuously rearwardly along, and continuously vertically downwardly from, the exerciser body right shoulder 66 of the exerciser body 16 of the exerciser 18, continuously vertically downwardly along an exerciser body back right side 63, i.e., inter alia, the general area of the Trapezius, of an exerciser body back 65 of the exerciser body 16 of the exerciser 18, to an exerciser body waist right back 69, i.e., inter alia, the general area of the Latissimus Dorsi, of the exerciser body waist 60 of the exerciser body 16 of the exerciser 18, where it is selectively maintained thereagainst by the waist belt 61.

The right side member strap 40 of the right side member 12 further extends continuously vertically downwardly from the exerciser body waist right back 69 of the exerciser body waist 66 of the exerciser body 16 of the exerciser 18, continuously vertically downwardly along an exerciser body right buttocks 71, i.e., inter alia, the general area of the Gluteus Maximus, of the exerciser body right leg 30 of the exerciser body right side 14 of the exerciser body 16 of the exerciser 18, continuously vertically downwardly along an exerciser body right leg thigh posterior portion 70, i.e., inter alia, the general area of the Biceps Flexor Cruris, of the exerciser body right leg thigh 56 of the exerciser body right leg 30 of the exerciser body right side 14 of the exerciser body 16 of the exerciser 18, to an exerciser body right leg knee posterior portion 72, i.e., inter alia, the general area of the popliteal space, of the exerciser body right leg knee 52 of the exerciser body right leg 30 of the exerciser body right side 14 of the exerciser body 16 of the exerciser 18, where it is selectively maintained thereagainst by the right side member knee maintaining apparatus 53 of the right side member 12.

The right side member strap 40 of the right side member 12 further extends continuously vertically downwardly from the exerciser body right leg knee posterior portion 72 of the exerciser body right leg knee 52 of the exerciser body right leg 30 of the exerciser body right side 14 of the exerciser body 16 of the exerciser 18, continuously vertically downwardly along an exerciser body right leg calf 74, i.e., inter alia, the general area of the Gastrocnemius, of the exerciser body right leg 30 of the exerciser body right side 14 of the exerciser body 16 of the exerciser 18, to an exerciser body right leg ankle posterior portion 76, i.e., inter alia, the general area of the Tendo Achillis, of the exerciser body right leg ankle 46 of the exerciser body right leg 30 of the exerciser body right side 14 of the exerciser body 16 of the exerciser 18.

The right side member strap 40 of the right side member 12 further extends continuously vertically downwardly from the exerciser body right leg ankle posterior portion 76 of the exerciser body right leg ankle 46 of the exerciser body right leg 30 of the exerciser body right side 14 of the exerciser body 16 of the exerciser 18, continuously vertically downwardly along the exerciser body right leg foot heel 38 of the exerciser body right leg foot 28 of the exerciser body right leg 30 of the exerciser body right side 14 of the exerciser body 16 of the exerciser 18, to the right side member right foot sole assembly heel area 36 of the right side member right foot sole assembly 24 of the right side member 12, where it is fixedly attached thereto.

The right side member knee maintaining apparatus 53 of the right side member 12 includes a right side member knee maintaining apparatus elastic sleeve 78 that replaceably and snugly encircles the exerciser body right leg knee 52 of the exerciser body right leg 30 of the exerciser body right side 14 of the exerciser body 16 of the exerciser 18.

The right side member knee maintaining apparatus elastic sleeve 78 of the right side member knee maintaining apparatus 53 of the right side member 12 has a right side member knee maintaining apparatus elastic sleeve anterior portion 80 that is abuttable against the exerciser body right leg knee anterior portion 50 of the exerciser body right leg knee 52 of the exerciser body right leg 30 of the exerciser body right side 14 of the exerciser body 16 of the exerciser 18, and a right side member knee maintaining apparatus elastic sleeve posterior portion 82 that is abuttable against the exerciser body right leg knee posterior portion 72 of the exerciser body right leg knee 52 of the exerciser body right leg 30 of the exerciser body right side 14 of the exerciser body 16 of the exerciser 18.

The right side member knee maintaining apparatus elastic sleeve anterior portion 80 of the right side member knee maintaining apparatus elastic sleeve 78 of the right side member knee maintaining apparatus 53 of the right side member 12 has a right side member knee maintaining apparatus elastic sleeve anterior portion flap 84 that is large and generally rectangular-shaped and disposed over most of the right side member knee maintaining apparatus elastic sleeve anterior portion 80 of the right side member knee maintaining apparatus elastic sleeve 78 of the right side member knee maintaining apparatus 53 of the right side member 12, and provides additional cushioning similar to that of a knee pad.

The body right side member knee maintaining apparatus elastic sleeve anterior portion flap 84 on the right side member knee maintaining apparatus elastic sleeve anterior portion 80 of the right side member knee maintaining apparatus elastic sleeve 78 of the right side member knee maintaining apparatus 53 of the right side member 12 has a body right side member knee maintaining apparatus elastic sleeve anterior portion flap first vertical edge 86 that is fixedly attached to the right side member knee maintaining apparatus elastic sleeve anterior portion 80 of the right side member knee maintaining apparatus elastic sleeve 78 of the right side member knee maintaining apparatus 53 of the right side member 12.

The body right side member knee maintaining apparatus elastic sleeve anterior portion flap 84 on the right side member knee maintaining apparatus elastic sleeve anterior portion 80 of the right side member knee maintaining apparatus elastic sleeve 78 of the right side member knee maintaining apparatus 53 of the right side member 12 further has a body right side member knee maintaining apparatus elastic sleeve anterior portion flap second vertical edge 88 that is spaced from, and opposes, the body right side member knee maintaining apparatus elastic sleeve anterior portion flap first vertical edge 86 of the body right side member knee maintaining apparatus elastic sleeve anterior portion flap 84 on the right side member knee maintaining apparatus elastic sleeve anterior portion 80 of the right side member knee maintaining apparatus elastic sleeve 78 of the right side member knee maintaining apparatus 53 of the right side member 12.

The body right side member knee maintaining apparatus elastic sleeve anterior portion flap second vertical edge 88 of the body right side member knee maintaining apparatus elastic sleeve anterior portion flap 84 on the right side member knee maintaining apparatus elastic sleeve anterior portion 80 of the right side member knee maintaining apparatus elastic sleeve 78 of the right side member knee maintaining apparatus 53 of the right side member 12 is releasibly and selectively maintained to the right side member knee maintaining apparatus elastic sleeve anterior portion 80 of the right side member knee maintaining apparatus elastic sleeve 78 of the right side member knee maintaining apparatus 53 of the right side member 12, by right side member knee maintaining apparatus anterior portion complementary portions of hook and loop fasteners (VELCRO®) 90.

The body right side member knee maintaining apparatus elastic sleeve anterior portion flap 84 on the right side member knee maintaining apparatus elastic sleeve anterior portion 80 of the right side member knee maintaining apparatus elastic sleeve 78 of the right side member knee maintaining apparatus 53 of the right side member 12, and the right side member knee maintaining apparatus elastic sleeve anterior portion 80 of the right side member knee maintaining apparatus elastic sleeve 78 of the right side member knee maintaining apparatus 53 of the right side member 12 define therebetween, a right side member knee maintaining apparatus elastic sleeve anterior portion space 92 that releasibly, snugly, and vertically receives the right side member strap 40 of the right side member 12 that extends continuously vertically along the exerciser body right leg knee anterior portion 50 of the exerciser body right leg knee 52 of the exerciser body right leg 30 of the exerciser body right side 14 of the exerciser body 16 of the exerciser 18, so that the right side member strap 40 of the right side member 12 can be selectively maintained against the exerciser body right leg knee anterior portion 50 of the exerciser body right leg knee 52 of the exerciser body right leg 30 of the exerciser body right side 14 of the exerciser body 16 of the exerciser 18, if so desired by the exerciser 18.

It is to be understood that as a result of the right side member knee maintaining apparatus anterior portion complementary portions of hook and loop fasteners (VELCRO®) 90 of the right side member knee maintaining apparatus 53 of the right side member 12, the right side member strap 40 of the right side member 12 can be easily secured to, and easily released frbody right leg kneebody right leg knee anterior portion 50 of t body right leg 30 of the exerciser body right side 14 of the exerciser body 16 of the exerciser 18.

The right side member knee maintaining apparatus elastic sleeve posterior portion 82 of the right side member knee maintaining apparatus elastic sleeve 78 of the right side member knee maintaining apparatus 53 of the right side member 12 has a right side member knee maintaining apparatus elastic sleeve posterior portion flap 94 that is small and generally rectangular-shaped and disposed across an upper part of the right side member knee maintaining apparatus elastic sleeve posterior portion 82 of the right side member knee maintaining apparatus elastic sleeve 78 of the right side member knee maintaining apparatus 53 of the right side member 12, so that the right side member knee maintaining apparatus elastic sleeve posterior portion flap 94 across the upper part of the right side member knee maintaining apparatus elastic sleeve posterior portion 82 of the right side member knee maintaining apparatus elastic sleeve 78 of the right side member knee maintaining apparatus 53 of the right side member 12 will not interfere with the exerciser body right leg knee posterior portion 72 of the exerciser body right leg knee 52 of the exerciser body right leg 30 of the exerciser body right side 14 of the exerciser body 16 of the exerciser 18 when the exerciser body right leg 30 of the exerciser body right side 14 of the exerciser body 16 of the exerciser 18 is flexed.

The right side member knee maintaining apparatus elastic sleeve posterior portion flap 94 on the right side member knee maintaining apparatus elastic sleeve posterior portion 82 of the right side member knee maintaining apparatus elastic sleeve 78 of the right side member knee maintaining apparatus 53 of the right side member 12 is smaller than the body right side member knee maintaining apparatus elastic sleeve anterior portion flap 84 on the right side member knee maintaining apparatus elastic sleeve anterior portion 80 of the right side member knee maintaining apparatus elastic sleeve 78 of the right side member knee maintaining apparatus 53 of the right side member 12.

The right side member knee maintaining apparatus elastic sleeve posterior portion flap 94 on the right side member knee maintaining apparatus elastic sleeve posterior portion 82 of the right side member knee maintaining apparatus elastic sleeve 78 of the right side member knee maintaining apparatus 53 of the right side member 12 has a right side member knee maintaining apparatus elastic sleeve posterior portion flap first vertical edge 96 that is fixedly attached to the right side member knee maintaining apparatus elastic sleeve posterior portion 82 of the right side member knee maintaining apparatus elastic sleeve 78 of the right side member knee maintaining apparatus 53 of the right side member 12.

The right side member knee maintaining apparatus elastic sleeve posterior portion flap 94 on the right side member knee maintaining apparatus elastic sleeve posterior portion 82 of the right side member knee maintaining apparatus elastic sleeve 78 of the right side member knee maintaining apparatus 53 of the right side member 12 further has a right side member knee maintaining apparatus elastic sleeve posterior portion flap second vertical edge 98 that is spaced from, and opposes, the right side member knee maintaining apparatus elastic sleeve posterior portion flap first vertical edge 96 of the right side member knee maintaining apparatus elastic sleeve posterior portion flap 94 on the right side member knee maintaining apparatus elastic sleeve posterior portion 82 of the right side member knee maintaining apparatus elastic sleeve 78 of the right side member knee maintaining apparatus 53 of the right side member 12.

The right side member knee maintaining apparatus elastic sleeve posterior portion flap second vertical edge 98 of the right side member knee maintaining apparatus elastic sleeve posterior portion flap 94 on the right side member knee maintaining apparatus elastic sleeve posterior portion 82 of the right side member knee maintaining apparatus elastic sleeve 78 of the right side member knee maintaining apparatus 53 of the right side member 12 is releasibly maintained to the right side member knee maintaining apparatus elastic sleeve posterior portion 82 of the right side member knee maintaining apparatus elastic sleeve 78 of the right side member knee maintaining apparatus 53 of the right side member 12, by right side member knee maintaining apparatus posterior portion complementary portions of hook and loop fasteners (VELCRO®) 100.

The right side member knee maintaining apparatus elastic sleeve posterior portion flap 94 on the right side member knee maintaining apparatus elastic sleeve posterior portion 82 of the right side member knee maintaining apparatus elastic sleeve 78 of the right side member knee maintaining apparatus 53 of the right side member 12, and the right side member knee maintaining apparatus elastic sleeve posterior portion 82 of the right side member knee maintaining apparatus elastic sleeve 78 of the right side member knee maintaining apparatus 53 of the right side member 12 define therebetween, a right side member knee maintaining apparatus elastic sleeve posterior portion space 102 that releasibly, snugly, and vertically receives the right side member strap 40 of the right side member 12 that extends continuously vertically along the exerciser body right leg knee posterior portion 72 of the exerciser body right leg knee 52 of the exerciser body right leg 30 of the exerciser body right side 14 of the exerciser body 16 of the exerciser 18, so that the right side member strap 40 of the right side member 12 can be selectively maintained against the exerciser body right leg knee posterior portion 72 of the exerciser body right leg knee 52 of the exerciser body right leg 30 of the exerciser body right side 14 of the exerciser body 16 of the exerciser 18, if so desired by the exerciser 18.

It is to be understood that as a result of the right side member knee maintaining apparatus posterior portion complementary portions of hook and loop fasteners (VELCRO®) 100 of the right side member knee maintaining apparatus 53 of the right side member 12, the right side member strap 40 of the right side member 12 can be easily secured to, and easily released from, the exerciser body right leg knee posterior portion 72 of the exerciser body right leg knee 52 of the exerciser body right leg 30 of the exerciser body right side 14 of the exerciser body 16 of the exerciser 18.

The right side member shoulder maintaining apparatus 67 of the right side member 12 includes a right side member shoulder maintaining apparatus cushion 104 that is rectangular-shaped and abuttable against the exerciser body right shoulder 66 of the exerciser body 16 of the exerciser 18, and has a right side member shoulder maintaining apparatus cushion outer surface 106.

The right side member shoulder maintaining apparatus 67 of the right side member 12 further includes a right side member shoulder maintaining apparatus flap 108 that is rectangular-shaped and disposed over a part of the right side member shoulder maintaining apparatus cushion outer surface 106 of the right side member shoulder maintaining apparatus cushion 104 of the right side member shoulder maintaining apparatus 67 of the right side member 12.

The right side member shoulder maintaining apparatus flap 108 on the right side member shoulder maintaining apparatus cushion outer surface 106 of the right side member shoulder maintaining apparatus cushion 104 of the right side member shoulder maintaining apparatus 67 of the right side member 12 has a right side member shoulder maintaining apparatus flap first lateral edge 110 that is fixedly attached to the right side member shoulder maintaining apparatus cushion outer surface 106 of the right side member shoulder maintaining apparatus cushion 104 of the right side member shoulder maintaining apparatus 67 of the right side member 12.

The right side member shoulder maintaining apparatus flap 108 on the right side member shoulder maintaining apparatus cushion outer surface 106 of the right side member shoulder maintaining apparatus cushion 104 of the right side member shoulder maintaining apparatus 67 of the right side member 12 further has a right side member shoulder maintaining apparatus flap second lateral edge 112 that is releasibly and selectively maintained to the right side member shoulder maintaining apparatus cushion outer surface 106 of the right side member shoulder maintaining apparatus cushion 104 of the right side member shoulder maintaining apparatus 67 of the right side member 12, by right side member shoulder maintaining apparatus complementary portions of hook and loop fasteners (VELCRO®) 114.

The right side member shoulder maintaining apparatus flap 108 on the right side member shoulder maintaining apparatus cushion outer surface 106 of the right side member shoulder maintaining apparatus cushion 104 of the right side member shoulder maintaining apparatus 67 of the right side member 12, and the right side member shoulder maintaining apparatus cushion outer surface 106 of the right side member shoulder maintaining apparatus cushion 104 of the right side member shoulder maintaining apparatus 67 of the right side member 12 define therebetween, a right side member shoulder maintaining apparatus space 116 that releasibly, snugly, and laterally receives the right side member strap 40 of the right side member 12 that extends continuously along the exerciser body right shoulder 66 of the exerciser body 16 of the exerciser 18, so that the right side member strap 40 of the right side member 12 can be comfortably and selectively maintained against the exerciser body right shoulder 66 of the exerciser body 16 of the exerciser 18, if so desired by the exerciser 18.

It is to be understood that as a result of the right side member shoulder maintaining apparatus complementary portions of hook and loop fasteners (VELCRO®) 114 of the right side member shoulder maintaining apparatus 67 of the right side member strap 40 of the right side member 12, the right side member strap 40 of the right side member 12 can be easily secured to, and easily released from, the exerciser body right shoulder 66 of the exerciser body 16 of the exerciser 18.

The body exercise device 10 further includes an upper body front retaining strap 118 that is releasible and flexible and releasibly encircles, and draws together, the right side member strap 40 of the right side member 12 and the left side member strap of the left side member 20, in the area of the exerciser body chest 64 of the exerciser body 16 of the exerciser 18, and is selectively maintained therearound by upper body front retaining strap free ends complementary portions of hook and loop fasteners (VELCRO®) 120 disposed on free ends thereof.

The body exercise device 10 further includes an upper body back retaining strap 122 that is releasible and flexible and releasibly encircles, and draws together, the right side member strap 40 of the right side member 12 and the body left side member strap of the left side member 20, in the area of the exerciser body back 65 of the exerciser body 16 of the exerciser 18, and is selectively maintained therearound by upper body back retaining strap free ends complementary portions of hook and loop fasteners (VELCRO®) 124 disposed on the free ends thereof.

Figure 4:
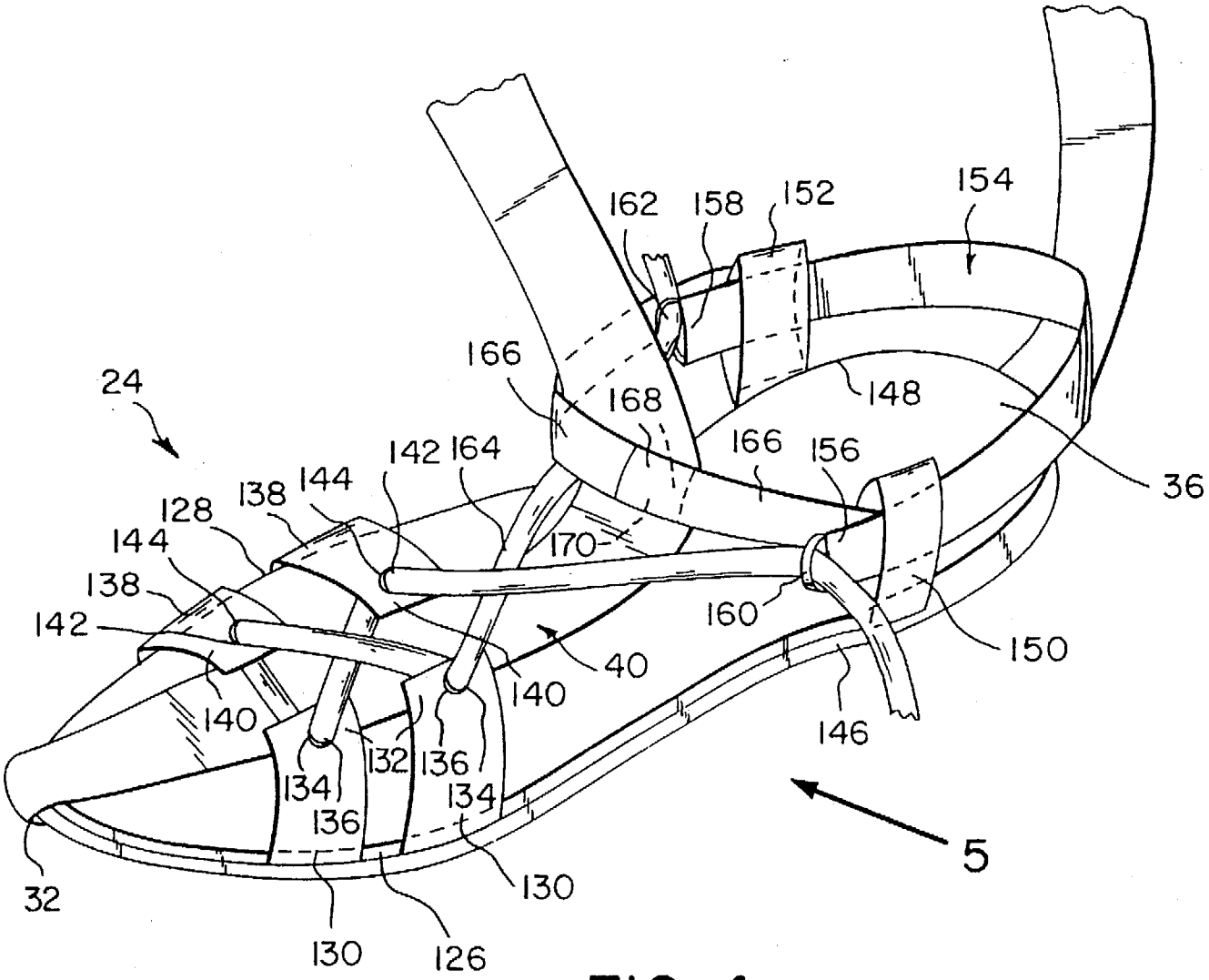
FIG. 4 is an enlarged side perspective view of the foot covering assembly.
Figure 5:
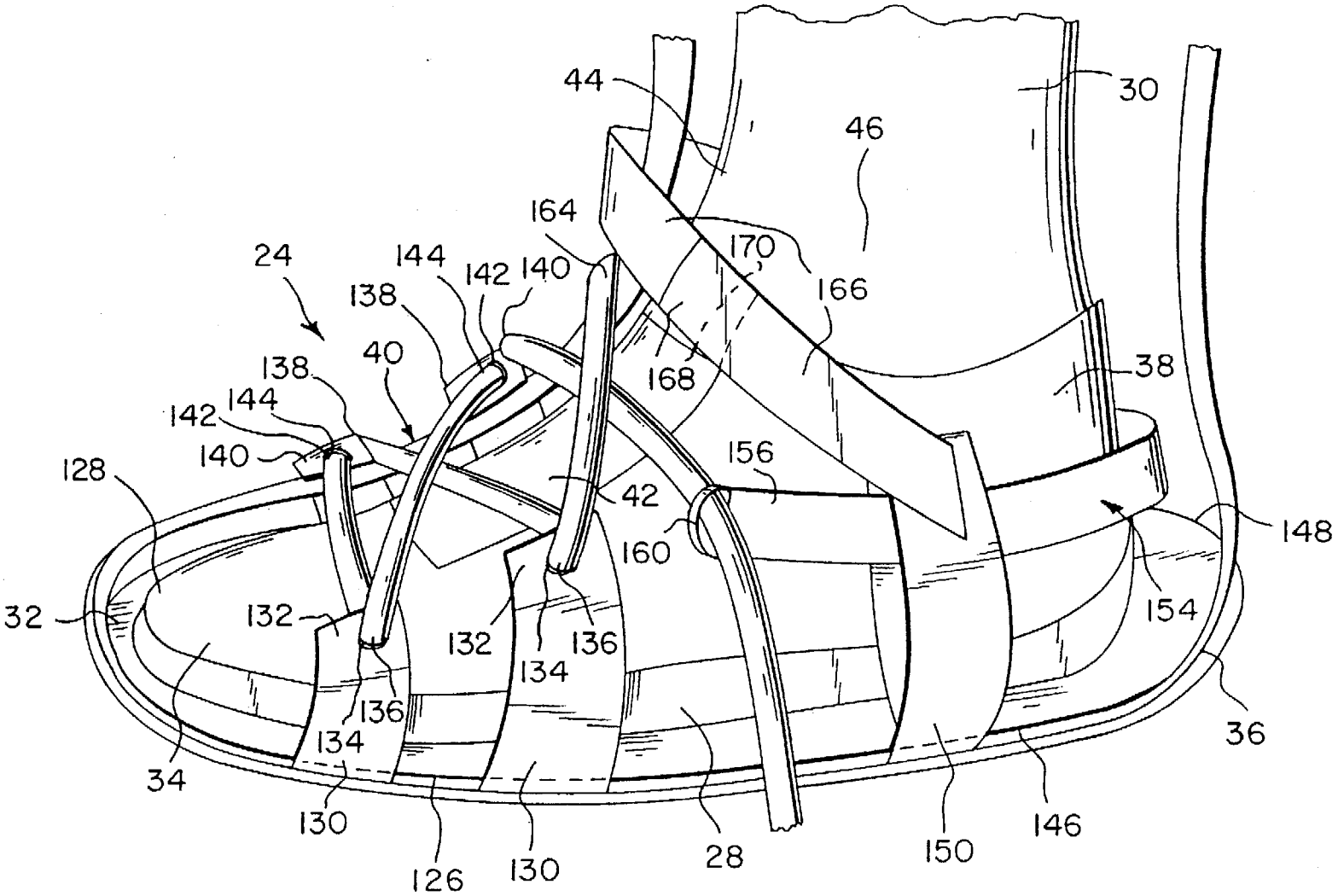
FIG. 5 is an enlarged side perspective view of the foot covering assembly donned on a foot of the exerciser, taken in the area generally enclosed by the broken ellipse identified by ARROW 5 in FIG. 2 and in the general direction of ARROW 5 in FIG. 4.

The configuration of the right side member right foot sole assembly 24 of the right side member 12, can best be seen in FIG. 4 and FIG. 5, which are an enlarged side perspective view of the foot covering assembly, and an enlarged side perspective view of the foot covering assembly donned on a foot of the exerciser, taken in the area generally enclosed by the broken ellipse identified by ARROW 5 in FIG. 2 and in the general direction of ARROW 5 in FIG. 4, respectively, and as such will be discussed with reference thereto.

The right side member right foot sole assembly toe area 32 of the right side member right foot sole assembly 24 of the right side member 12 has a right side member right foot sole assembly toe area first longitudinal side 126 that is convex-shaped, and a right side member right foot sole assembly toe area second longitudinal side 128 that is convex-shaped and spaced from, and opposes, the right side member right foot sole assembly toe area first longitudinal side 126 of the right side member right foot sole assembly toe area 32 of the right side member right foot sole assembly 24 of the right side member 12.

The right side member right foot sole assembly 24 of the right side member 12 includes a right side member right foot sole assembly toe area first pair of toe straps 130 that are substantially parallel, spaced-apart, slender, and flexible, and extend vertically upwardly from the right side member right foot sole assembly toe area first longitudinal side 126 of the right side member right foot sole assembly toe area 32 of the right side member right foot sole assembly 24 of the right side member 12.

The forwardmost strap of the right side member right foot sole assembly toe area first pair of toe straps 130 of the right side member right foot sole assembly 24 of the right side member 12 is abuttable against an upper portion of at least one toe of the exerciser body right leg foot toes 34 of the exerciser body right leg foot 28 of the exerciser body right leg 30 of the exerciser body right side 14 of the exerciser body 16 of the exerciser 18, while the rearmost strap of the right side member right foot sole assembly toe area first pair of toe straps 130 of the right side member right foot sole assembly 24 of the right side member 12 is abuttable against at least a portion of the exerciser body right leg foot instep 42 of the exerciser body right leg foot 28 of the exerciser body right leg 30 of the exerciser body right side 14 of the exerciser body 16 of the exerciser 18.

Each strap of the right side member right foot sole assembly toe area first pair of toe straps 130 of the right side member right foot sole assembly 24 of the right side member 12 has a right side member right foot sole assembly toe area first pair toe strap free end 132 with a right side member right foot sole assembly toe area first pair toe strap free end throughbore 134 extending therethrough, in which a right side member right foot sole assembly toe area first pair toe strap free end throughbore eyelet 136 is disposed.

The right side member right foot sole assembly 24 of the right side member 12 further includes a right side member right foot sole assembly toe area second pair of toe straps 138 that is substantially parallel, spaced-apart, slender, and flexible, and extend vertically upwardly from the right side member right foot sole assembly toe area second longitudinal side 128 of the right side member right foot sole assembly toe area 32 of the right side member right foot sole assembly 24 of the right side member 12.

The forwardmost strap of the right side member right foot sole assembly toe area second pair of toe straps 138 of the right side member right foot sole assembly 24 of the right side member 12 is abuttable against an upper portion of at least one remaining toe of the exerciser body right leg foot toes 34 of the exerciser body right leg foot 28 of the exerciser body right leg 30 of the exerciser body right side 14 of the exerciser body 16 of the exerciser 18, while the rearmost strap of the right side member right foot sole assembly toe area second pair of toe straps 138 of the right side member right foot sole assembly 24 of the right side member 12 is abuttable against at least a portion of the exerciser body right leg foot instep 42 of the exerciser body right leg foot 28 of the exerciser body right leg 30 of the exerciser body right side 14 of the exercise body 16 of the exerciser 18.

The right side member right foot sole assembly toe area second pair of toe straps 138 of the right side member right foot sole assembly 24 of the right side member 12 overlap the right side member strap 40 of the right side member 12.

The forwardmost strap of the right side member right foot sole assembly toe area second pair of toe straps 138 of the right side member right foot sole assembly 24 of the right side member 12 is in opposing alignment with the forwardmost strap of the right side member right foot sole assembly toe area first pair of toe straps 130 of the right side member right foot sole assembly 24 of the right side member 12, while the rearmost strap of the right side member right foot sole assembly toe area second pair of toe straps 138 of the right side member right foot sole assembly 24 of the right side member 12 is in opposing alignment with the rearmost strap of the right side member right foot sole assembly toe area first pair of toe straps 130 of the right side member right foot sole assembly 24 of the right side member 12.

Each strap of the right side member right foot sole assembly toe area second pair of toe straps 138 of the right side member right foot sole assembly 24 of the right side member 12 has a right side member right foot sole assembly toe area second pair toe strap free end 140 with a right side member right foot sole assembly toe area second pair toe strap free end throughbore 142 extending therethrough, in which a right side member right foot sole assembly toe area second pair toe strap free end throughbore eyelet 14, is disposed.

The right side member right foot sole assembly heel area 36 of the right side member right foot sole assembly 24 of the right side member 12 has a right side member right foot sole assembly heel area first longitudinal side 146 that is convex-shaped and continuous with the right side member right foot sole assembly toe area first longitudinal side 126 of the right side member right foot sole assembly toe area 32 of the right side member right foot sole assembly 24 of the right side member 12.

The right side member right foot sole assembly heel area 36 of the right side member right foot sole assembly 24 of the right side member 12 further has a right side member right foot sole assembly heel area second longitudinal side 148 that is convex-shaped and continuous with the right side member right foot sole assembly toe area second longitudinal side 128 of the right side member right foot sole assembly toe area 32 of the right side member right foot sole assembly 24 of the right side member 12, and spaced from, and opposing, the right side member right foot sole assembly heel area first longitudinal side 146 of the right side member right foot sole assembly heel area 36 of the right side member right foot sole assembly 24 of the right side member 12.

The right side member right foot sole assembly 24 of the right side member 12 further includes a right side member right foot sole assembly heel area first strap 150 that is flexible and formed as a loop and extends vertically upwardly from the right side member right foot sole assembly heel area first longitudinal side 146 of the right side member right foot sole assembly heel area 36 of the right side member right foot sole assembly 24 of the right side member 12, in general alignment with the right side member right foot sole assembly toe area first pair of toe straps 130 of the right side member right foot sole assembly 24 of the right side member 12, and is abuttable against a first longitudinal side portion of the exerciser body right leg foot heel 38 of the exerciser body right leg foot 28 of the exerciser body right leg 30 of the exerciser body right side 14 of the exerciser body 16 of the exerciser 18.

The right side member right foot sole assembly 24 of the right side member 12 further includes a right side member right foot sole assembly heel area second strap 152 that is flexible and formed as a loop and extends vertically upwardly from the right side member right foot sole assembly heel area second longitudinal side 148 of the right side member right foot sole assembly heel area 36 of the right side member right foot sole assembly 24 of the right side member 12, and is abuttable against a second longitudinal side portion of the exerciser body right leg foot heel 38 of the exerciser body right leg foot 28 of the exerciser body right leg 30 of the exerciser body right side 14 of the exerciser body 16 of the exerciser 18 which is spaced from, and opposes, the first longitudinal side portion of the exerciser body right leg foot heel 38 of the exerciser body right leg foot 28 of the exerciser body right leg 30 of the exerciser body right side 14 of the exerciser body 16 of the exerciser 18.

The right side member right foot sole assembly heel area second strap 152 of the right side member right foot sole assembly 24 of the right side member 12 is spaced from, and opposes, the right side member right foot sole assembly heel area first strap 150 of the right side member right foot sole assembly 24 of the right side member 12, and is in general alignment with the right side member right foot sole assembly toe area second pair of toe straps 138 of the right side member right foot sole assembly 24 of the right side member 12.

The right side member right foot sole assembly 24 of the right side member 12 further includes a right side member right foot sole assembly heel area strap 154 that is flexible, generally horizontally-oriented, and generally U-shaped, and generally horizontally wrappable around, and abuttable against, the first longitudinal side portion, the rear lateral portion, and the second longitudinal side portion of the exerciser body right leg foot heel 38 of the exerciser body right leg foot 28 of the exerciser body right leg 30 of the exerciser body right side 14 of the exerciser body 16 of the exerciser 18.

The right side member right foot sole assembly heel area strap 154 of the right side member right foot sole assembly 24 of the right side member 12 has a right side member right foot sole assembly heel area strap first free end 156, and a right side member right foot sole assembly heel area strap second free end 158.

The right side member right foot sole assembly heel area strap first free end 156 of the right side member right foot sole assembly heel area strap 154 of the right side member right foot sole assembly 24 of the right side member 12 passes freely, slidingly, and forwardly through the right side member right foot sole assembly heel area first strap 150 of the right side member right foot sole assembly 24 of the right side member 12, and terminates in a right side member right foot sole assembly heel area strap first free end ring 160, while the right side member right foot sole assembly heel area strap second free end 158 of the right side member right foot sole assembly heel area strap 154 of the right side member right foot sole assembly 24 of the right side member 12 passes freely, slidingly, and forwardly through the right side member right foot sole assembly heel area second strap 152 of the right side member right foot sole assembly 24 of the right side member 12, and terminates in a right side member right foot sole assembly heel area strap second free end ring 162.

The right side member right foot sole assembly 24 of the right side member 12 further includes a right side member right foot sole assembly lace 164 that laces up the right side member right foot sole assembly 24 of the right side member 12, in a fashion similar to that of a conventional laced shoe, and selectively maintains the right side member strap 40 of the right side member 12 against the exerciser body right leg foot instep 42 of the exerciser body right leg foot 28 of the exerciser body right leg 30 of the exerciser body right side 14 of the exerciser body 16 of the exerciser 18.

One free end of the right side member right foot sole assembly lace 164 of the right side member right foot sole assembly 24 of the right side member 12 passes freely through the right side member right foot sole assembly toe area first pair toe strap free end throughbore eyelet 136 in the right side member right foot sole assembly toe area first pair toe strap free end throughbore 134 in the right side member right foot sole assembly toe area first pair toe strap free end 132 of the forwardmost strap of the right side member right foot sole assembly toe area first pair of toe straps 130 of the right side member right foot sole assembly 24 of the right side member 12, while another free end of the right side member right foot sole assembly lace 164 of the right side member right foot sole assembly 24 of the right side member 12 passes freely through the right side member right foot sole assembly toe area second pair toe strap free end throughbore eyelet 144 in the right side member right foot sole assembly toe area second pair toe strap free end throughbore 142 in the right side member right foot sole assembly toe area second pair toe strap free end 140 of the forwardmost strap of the right side member right foot sole assembly toe area second pair of toe straps 138 of the right side member right foot sole assembly 24 of the right side member 12, and is criss-crossed with the one free end of the right side member right foot sole assembly lace 164 of the right side member right foot sole assembly 24 of the right side member 12.

The another free end of the right side member right foot sole assembly lace 164 of the right side member right foot sole assembly 24 of the right side member 12 then passes freely through the right side member right foot sole assembly toe area first pair toe strap free end throughbore eyelet 136 in the right side member right foot sole assembly toe area first pair toe strap free end throughbore 134 in the right side member right foot sole assembly toe area first pair toe strap free end 132 of the rearmost strap of the right side member right foot sole assembly toe area first pair of toe straps 130 of the right side member right foot sole assembly 24 of the right side member 12, while the one free end of the right side member right foot sole assembly lace 164 of the right side member right foot sole assembly 24 of the right side member 12 passes freely through the right side member right foot sole assembly toe area second pair toe strap free end throughbore eyelet 144 in the right side member right foot sole assembly toe area second pair toe strap free end throughbore 142 in the right side member right foot sole assembly toe area second pair toe strap free end 140 of the rearmost strap of the right side member right foot sole assembly toe area second pair of toe straps 138 of the right side member right foot sole assembly 24 of the right side member 12, and is again criss-crossed with the another free end of the right side member right foot sole assembly lace 164 of the right side member right foot sole assembly 24 of the right side member 12.

The one free end of the right side member right foot sole assembly lace 164 of the right side member right foot sole assembly 24 of the right side member 12 then passes freely through the right side member right foot sole assembly heel area strap first free end ring 160 on the right side member right foot sole assembly heel area strap first free end 156 of the right side member right foot sole assembly heel area strap 154 of the right side member right foot sole assembly 24 of the right side member 12, while the another free end of the right side member right foot sole assembly lace 164 of the right side member right foot sole assembly 24 of the right side member 12 passes freely through the right side member right foot sole assembly heel area strap second free end ring 162 on the right side member right foot sole assembly heel area strap second free end 158 of the right side member right foot sole assembly heel area strap 154 of the right side member right foot sole assembly 24 of the right side member 12, and is again criss-crossed and tieable with the one end of the right side member right foot sole assembly lace 164 of the right side member right foot sole assembly 24 of the right side member 12 against the exerciser body right leg foot instep 42 of the exerciser body right leg foot 28 of the exerciser body right leg 30 of the exerciser body right side 14 of the exerciser body 16 of the exerciser 18 so as to cause the right side member right foot sole assembly heel area strap 154 of the right side member right foot sole assembly 24 of the right side member 12 to abut snugly against the exerciser body right leg foot heel 38 of the exerciser body right leg foot 28 of the exerciser body right leg 30 of the exerciser body right side 14 of the exerciser body 16 of the exerciser 18 and the right side member strap 40 of the right side member 12 can be selectively maintained against the exerciser body right leg foot instep 42 of the exerciser body right leg foot 28 of the exerciser body right leg 30 of the exerciser body right side 14 of the exerciser body 16 of the exerciser 18, if so desired by the exerciser 18.

The right side member right foot sole assembly 24 of the right side member 12 further includes a right side member right foot sole assembly pair of instep straps 166 that are flexible and have right side member right foot sole assembly pair of instep straps overlapping free ends 168 with right side member right foot sole assembly pair of instep straps overlapping free ends complementary portions of hook and loop fasteners (VELCRO®) 170 disposed thereon.

One strap of the right side member right foot sole assembly pair of instep straps 166 of the right side member right foot sole assembly 24 of the right side member 12 is fixedly attached to, and extends generally obliquely—forwardly—upwardly from, the right side member right foot sole assembly heel area first strap 150 of the right side member right foot sole assembly 24 of the right side member 12, and over that portion of the right side member strap 40 of the right side member 12 that is selectively maintained against the exerciser body right leg foot instep 42 of the exerciser body right leg foot 28 of the exerciser body right leg 30 of the exerciser body right side 14 of the exerciser body 16 of the exerciser 18. Another strap of the right side member right foot sole assembly pair of flexible instep straps 166 of the right side member right foot sole assembly 24 of the right side member 12 is fixedly attached to, and extends generally obliquely—forwardly—upwardly from, the right side member right foot sole assembly heel area second strap 152 of the right side member right foot sole assembly 24 of the right side member 12, and over that portion of the right side member strap 40 of the right side member 12 that is selectively maintained against the exerciser body right leg foot instep 42 of the exerciser body right leg foot 28 of the exerciser body right leg 30 of the exerciser body right side 14 of the exerciser body 16 of the exerciser 18.

A portion of right side member right foot sole assembly pair of instep straps overlapping free ends complementary portions of hook and loop fasteners (VELCRO®) 170 disposed on a free end of a right side member right foot sole assembly pair of instep straps overlapping free ends 168 of the one strap of the right side member right foot sole assembly pair of instep straps 166 of the right side member right foot sole assembly 24 of the right side member 12 releasibly engages with a complementary portion of the body right side member right foot sole assembly pair of instep straps overlapping free ends complementary portions of hook and loop fasteners (VELCRO®) 170 on a free end of the right side member right foot sole assembly pair of instep straps overlapping free ends 168 of another strap of the right side member right foot sole assembly pair of instep straps 166 of the right side member right foot sole assembly 24 of the right side member 12, so that the right side member strap 40 of the right side member 12 can be selectively maintained against the exerciser body right leg foot instep 42 of the exerciser body right leg foot 28 of the exerciser body right leg 30 of the exerciser body right side 14 of the exerciser body 16 of the exerciser 18, if so desired by the exerciser 18.

It will be understood that each of the elements described above, or two or more together, may also find a useful application in other types of constructions differing from the types described above.

While the invention has been illustrated and described as embodied in a body exercise device, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A body exercise device attachable to an exerciser, comprising:

a) a right member being elastic, elongated, slender, and formed as a closed loop for vertically encircling the right side of the exerciser; said right member including a strap being one-piece, continuous, elastic, elongated, and slender; said strap of said right member having a length and a tension;

b) right shoulder engaging means for selectively maintaining said right member against the right shoulder of the exerciser;

c) right waist engaging means for selectively maintaining said right member against the waist of the exerciser; said right waist engaging means being capable of maintaining said right member against the exerciser's waist on both his front and back sides;

d) right knee engaging means for selectively maintaining said right member against the right knee of the exerciser; said right knee engaging means being capable of maintaining said right member against either the front or back of the exerciser's right knee;

e) right foot engaging means for selectively maintaining said right member against the right foot of the exerciser;

f) a right sole assembly attached to said right foot engaging means; said right sole assembly having a toe portion and a heel portion, and being positionable on the right sole of the exerciser; said right foot engaging means including said right sole assembly; said strap of said right member being fixedly attached at one end thereof to, and extending continuously vertically upwardly from, said toe area of said right sole assembly, continuously vertically upwardly along the instep of the right foot of the exerciser, where it is selectively maintained thereagainst by said right sole assembly, to the front of the right ankle of the exerciser; said toe area of said right sole assembly having a first longitudinal side being convex-shaped, and a second longitudinal side being convex-shaped and spaced from, and opposing, said first longitudinal side of said toe area of said right sole assembly; said right sole assembly including a first pair of toe straps being substantially parallel, spaced-apart, slender, and flexible and extending vertically upwardly from said first longitudinal side of said toe area of said right sole assembly; a forwardmost strap of said first pair of toe straps of said right sole assembly being abuttable against an upper portion of at least one toe of the right foot of the exerciser, while a rearmost strap of said first pair of toe straps of said right sole assembly being abuttable against at least a portion of the right instep of the exerciser; each strap of said first pair of toe straps of said right sole assembly having a free end with a throughbore extending therethrough, in which an eyelet is disposed; said right sole assembly further including a second pair of toe straps being substantially parallel, spaced-apart, slender, and flexible and extending vertically upwardly from said second longitudinal side of said toe area of said right sole assembly; a forwardmost strap of said second pair of toe straps of said right sole assembly being abuttable against an upper portion of at least one remaining toe of the right foot of the exerciser, while a rearmost strap of said second pair of toe straps of said right sole assembly being abuttable against at least a portion of the right instep of the exerciser; said forwardmost strap of said second pair of toe straps of said right sole assembly being in opposing alignment with said forwardmost strap of said first pair of toe straps of said right sole assembly, while said rearmost strap of said second pair of toe straps of said right sole assembly being in opposing alignment with said rearmost strap of said first pair of toe straps of said right sole assembly; each strap of said second pair of straps of said right sole assembly having a free end with a throughbore extending therethrough, in which an eyelet is disposed; said heel area of said right sole assembly having a first longitudinal side being convex-shaped and continuous with said first longitudinal side of said toe area of said right sole assembly; said heel area of said right sole assembly further having a second longitudinal side being convex-shaped and continuous with said second longitudinal side of said toe area of said right sole assembly, and spaced from, and opposing, said first longitudinal side of said heel area of said right sole assembly; said right sole assembly further including a first strap that is flexible and formed as a loop and extending vertically upwardly from said first longitudinal side of said heel area of said right sole assembly, in general alignment with said first pair of toe straps of said right sole assembly, and being abuttable against a first longitudinal side portion of the right heel of the exerciser; said right sole assembly further including a second strap being flexible and formed as a loop and extending vertically upwardly from said second longitudinal side of said heel area of said right sole assembly; said second strap of said right sole assembly being abuttable against a second longitudinal side of the right heel of the exerciser which is spaced from, and opposes, said first longitudinal side of the right heel of the exerciser; said second strap of said right sole assembly being spaced from, and opposing, said first strap of said right sole assembly, and being in general alignment with said second pair of toe straps of said right sole assembly; said right sole assembly further including a third strap being flexible, generally horizontally-oriented, and generally U-shaped; said third strap of said right sole assembly being generally horizontally wrappable around, and abuttable against, a portion of the right heel of the exerciser; said third strap of said right sole assembly having a first free end and a second free end; said first free end of said third strap of said right sole assembly passing forwardly, freely, and slidingly through said first strap of said right sole assembly, and terminating with a ring, while said second free end of said third strap of said right sole assembly passing forwardly, freely, and slidingly through said second strap of said right sole assembly, and terminating with a ring; said right sole assembly further including a lace lacing up said right sole assembly and selectively maintaining said strap of said right member against the right instep of the exerciser; one end of said lace of said right sole assembly passing freely through said eyelet in said throughbore in said free end of said forwardmost strap of said first pair of toe straps of said right sole assembly, while another end of said lace of said right sole assembly passing freely through said eyelet in said throughbore in said free end of said forwardmost strap of said second pair of toe straps of said right sole assembly, and being criss-crossed with said one end of said lace of said right sole assembly; said another end of said lace of said right sole assembly then passing freely through said eyelet in said throughbore in said free end of said rearmost strap of said first pair of toe straps of said right sole assembly, while said one end of said lace of said right sole assembly passing freely through said eyelet in said throughbore in said free end of said rearmost strap of said second pair of toe straps of said right sole assembly, and being again criss-crossed with said another end of said lace of said right sole assembly; said one end of said lace of said right sole assembly then passing freely through said ring on said first free end of said third strap of said right sole assembly, while said another end of said lace of said right sole assembly passing freely through said ring on said second free end of said third strap of said right sole assembly and being again criss-crossed and tieable with said one end of said lace of said right sole assembly over said strap of said right member and against the right instep of the exerciser so as to cause said third strap of said right sole assembly to abut snugly against the right heel of the exerciser while selectively maintaining said strap of said right member against the right instep of the exerciser; said right sole assembly further including a pair of instep straps being flexible and having overlapping free ends with complementary portions of hook and loop fasteners disposed thereon; one strap of said pair of instep straps of said right sole assembly being fixedly attached to, and extending generally obliquely—forwardly—upwardly from, said first strap of said right sole assembly, and over said strap of said right member being further selectively maintained against the right instep of the exerciser by virtue of a portion of said complementary portions of hook and loop fasteners disposed on said free end of one strap of said pair of instep straps of said right sole assembly releasibly engaging with a complementary portion of said complementary portions of hook and loop fasteners disposed on said free end of another strap of said pair of instep straps of said right sole assembly; said another strap of said pair of instep straps of said right sole assembly being fixedly attached to, and extending generally obliquely—forwardly—upwardly from, said second strap of said right sole assembly, and over said strap of said right member being further selectively maintained against the right instep of the exerciser by virtue of said complementary portion of said complementary portions of hook and loop fasteners disposed on said free end of said another strap of said pair of instep straps of said right sole assembly releasibly engaging with said portion of said complementary portions of hook and loop fasteners disposed on said free end of said one strap of said pair of instep straps of said right sole assembly;

g) a left member being elastic, elongated, slender, and formed as a closed loop for vertically encircling the left side of the exerciser; said left member including a strap being one-piece, continuous, elastic, elongated, and slender; said strap of said left member having a length and a tension;

h) left shoulder engaging means for selectively maintaining said left member against the left shoulder of the exerciser;

i) left waist engaging means for selectively maintaining said left member against the waist of the exerciser; said left waist engaging means being capable of maintaining said left member against the exerciser's waist on both his front and back sides;

j) left knee engaging means for selectively maintaining said left member against the left knee of the exerciser; said left knee engaging means being capable of maintaining said left member against either the front or back of the exerciser's right knee;

k) left foot engaging means for selectively maintaining said left member against the left foot of the exerciser; and l) a left sole assembly attached to said left foot engaging means; said left sole assembly having a toe portion and a heel portion, and being positionable on the left sole of the exerciser; said left foot engaging means including said left sole assembly; said strap of said left member being fixedly attached at one end thereof to, and extending continuously vertically upwardly from, said toe area of said left sole assembly, continuously vertically upwardly along the instep of the left foot of the exerciser, where it is selectively maintained thereagainst by said left sole assembly, to the front of the left ankle of the exerciser; said toe area of said left sole assembly having a first longitudinal side being convex-shaped, and a second longitudinal side being convex-shaped and spaced from, and opposing, said first longitudinal side of said toe area of said left sole assembly; said left sole assembly including a first pair of toe straps being substantially parallel, spaced-apart, slender, and flexible and extending vertically upwardly from said first longitudinal side of said toe area of said left sole assembly; a forwardmost strap of said first pair of toe straps of said left sole assembly being abuttable against an upper portion of at least one toe of the left foot of the exerciser, while a rearmost strap of said first pair of toe straps of said left sole assembly being abuttable against at least a portion of the left instep of the exerciser; each strap of said first pair of toe straps of said left sole assembly having a free end with a throughbore extending therethrough, in which an eyelet is disposed; said left sole assembly further including a second pair of toe straps that are substantially parallel, spaced-apart, slender, and flexible and extending vertically upwardly from said second longitudinal side of said toe area of said left sole assembly; a forwardmost strap of said second pair of toe straps of said left sole assembly being abuttable against an upper portion of at least one remaining toe of the left foot of the exerciser, while a rearmost strap of said second pair of toe straps of said left sole assembly being abuttable against at least a portion of the left instep of the exerciser; said forwardmost strap of said second pair of toe straps of said left sole assembly being in opposing alignment with said forwardmost strap of said first pair of toe straps of said left sole assembly, while said rearmost strap of said second pair of toe straps of said left sole assembly being in opposing alignment with said rearmost strap of said first pair of toe straps of said left sole assembly; each strap of said second pair of toe straps of said left sole assembly having a free end with a throughbore extending therethrough, in which an eyelet is disposed; said heel area of said left sole assembly having a first longitudinal side being convex-shaped and continuous with said first longitudinal side of said toe area of said left sole assembly; said heel area of said left sole assembly further having a second longitudinal side being convex-shaped and continuous with said second longitudinal side of said toe area of said left sole assembly, and spaced from, and opposing, said first longitudinal side of said heel area of said left sole assembly; said left sole assembly further including a first strap being flexible and formed as a loop and extending vertically upwardly from said first longitudinal side of said heel area of said left sole assembly, in general alignment with said first pair of toe straps of said left sole assembly, and being abuttable against a first longitudinal side portion of the left heel of the exerciser; said left sole assembly further including a second strap being flexible and formed as a loop and extending vertically upwardly from said second longitudinal side of said heel area of said left sole assembly; said second strap of said left sole assembly being abuttable against a second longitudinal side of the left heel of the exerciser which is spaced from, and opposes, said first longitudinal side of the left heel of the exerciser; said second strap of said left sole assembly being spaced from, and opposing, said first strap of said left sole assembly, and being in general alignment with said second pair of toe straps of said left sole assembly; said left sole assembly further including a third strap being flexible, generally horizontally-oriented, and generally U-shaped; said third strap of said left sole assembly being generally horizontally wrappable around, and abuttable against, a portion of the left heel of the exerciser; said third strap of said left sole assembly having a first free end and a second free end; said first free end of said third strap of said left sole assembly passing forwardly, freely, and slidingly through said first strap of said left sole assembly, and terminating with a ring, while said second free end of said third strap of said left sole assembly passing forwardly, freely, and slidingly through said second strap of said left sole assembly, and terminating with a ring; said left sole assembly further including a lace lacing up said left sole assembly and selectively maintaining said strap of said left member against the left instep of the exerciser; one end of said lace of said left sole assembly passing freely through said eyelet in said throughbore of said free end of said forwardmost strap of said first pair of toe straps of said left sole assembly, while another end of said lace of said left sole assembly passing freely through said eyelet in said throughbore in said free end of said forwardmost strap of said second pair of toe straps of said left sole assembly, and being criss-crossed with said one end of said lace of said left sole assembly; said another end of said lace of said left sole assembly then passing freely through said eyelet in said throughbore in said free end of said rearmost strap of said first pair of toe straps of said left sole assembly, while said one end of said lace of said left sole assembly passing freely through said eyelet in said throughbore in said free end of said rearmost strap of said second pair of toe straps of said left sole assembly, and being again criss-crossed with said another end of said lace of said left sole assembly; said one end of said lace of said left sole assembly then passing freely through said ring on said first free end of said third strap of said left sole assembly, while said another end of said lace of said left sole assembly passing freely through said ring on said second free end of said third strap of said left sole assembly and being again criss-crossed and tieable with said one end of said lace of said left sole assembly over said strap of said left member and against the left instep of the exerciser so as to cause said third strap of said left sole assembly to abut snugly against the left heel of the exerciser while selectively maintaining said strap of said left member against the left instep of the exerciser; said left sole assembly further including a pair of instep straps being flexible and having overlapping free ends with complementary portions of hook and loop fasteners disposed thereon; one strap of said pair of instep straps of said left sole assembly being fixedly attached to, and extending generally obliquely—forwardly—upwardly from, said first strap of said left sole assembly, and over said strap of said left member being further selectively maintained against the left instep of the exerciser by virtue of a portion of said complementary portions of hook and loop fasteners disposed on said free end of one strap of said pair of instep straps of said left sole assembly releasibly engaging with a complementary portion of said complementary portions of hook and loop fasteners disposed on said free end of another strap of said pair of instep straps of said left sole assembly; said another strap of said pair of instep straps of said left sole assembly being fixedly attached to, and extending generally obliquely—forwardly—upwardly from, said second strap of said left sole assembly, and over said strap of said left member being further selectively maintained against the left instep of the exerciser by virtue of said complementary portion of said complementary portions of hook and loop fasteners disposed on said free end of said another strap of said pair of instep straps of said left sole assembly releasibly engaging with said portion of said complementary portions of hook and loop fasteners disposed on said free end of said one strap of said pair of instep straps of said left sole assembly.

2. The device as defined in claim 1, wherein said strap of said right member further extends continuously vertically upwardly from the front of the right ankle of the exerciser, continuously vertically upwardly along the right shin of the exerciser, to the front of the right knee of the exerciser, where it is selectively maintained thereagainst by said right knee engaging means; said strap of said left member further extends continuously vertically upwardly from the front of the left ankle of the exerciser, continuously vertically upwardly along the left shin of the exerciser, to the front of the left knee of the exerciser, where it is selectively maintained thereagainst by said left knee engaging means.

3. The device as defined in claim 2, wherein said strap of said right member further extends continuously vertically upwardly from the front of the right knee of the exerciser, continuously vertically upwardly along the front of the right thigh of the exerciser, to the front of the waist of the body of the exerciser, where it is selectively maintained thereagainst by said right waist engaging means; said strap of said left loop member further extends continuously vertically upwardly from the front of the left knee of the exerciser, continuously vertically upwardly along the front of the left thigh of the exerciser, to the front of the waist of the exerciser, where it is selectively maintained thereagainst by said left waist engaging means.

4. The device as defined in claim 3, wherein said strap of said right member further extends continuously vertically upwardly from the front of the waist of the exerciser, continuously vertically upwardly along the right breast of the exerciser, to the right shoulder of the exerciser, where it is selectively maintained thereagainst by said right shoulder engaging means; said strap of said left member further extends continuously vertically upwardly from the front of the waist of the exerciser, continuously vertically upwardly along the left breast of the exerciser, to the left shoulder of the exerciser, where it is selectively maintained thereagainst by said left shoulder engaging means.

5. The device as defined in claim 4, wherein said right member includes a tension clip disposed on that portion of said strap of said right member that extends continuously vertically upwardly from the front of the waist of the exerciser, continuously vertically upwardly along the right breast of the exerciser, to the right shoulder of the exerciser, so that said length and said tension of said strap of said right member can be adjusted to resistance preferred by the exerciser and for the height thereof; said left member includes a tension clip disposed on that portion of said strap of said left member that extends continuously vertically upwardly from the front of the waist of the exerciser, continuously vertically upwardly along the left breast of the exerciser, to the left shoulder of the exerciser, so that said length and said tension of said strap of said left member can be adjusted to resistance preferred by the exerciser and for the height thereof.

6. The device as defined in claim 4, wherein said strap of said right member further extends continuously rearwardly along, and continuously vertically downwardly from, the right shoulder of the exerciser, continuously vertically downwardly along the back of the exerciser, to the back of the waist of the exerciser, where it is selectively maintained thereagainst by said right waist engaging means; said strap of said left loop member further extends continuously rearwardly along, and continuously vertically downwardly from, the left shoulder of the exerciser, continuously vertically downwardly along the back of the exerciser, to the back of the waist of the exerciser, where it is selectively maintained thereagainst by said left waist engaging means.

7. The device as defined in claim 6, wherein said strap of said right loop member further extends continuously vertically downwardly from the front of the waist of the exerciser, continuously vertically downwardly along the right buttocks of the exerciser, continuously vertically downwardly along the back of the right thigh of the exerciser, to the back of the right knee of the exerciser, where it is selectively maintained thereagainst by said right knee engaging means; said strap of said left member further extends continuously vertically downwardly from the back of the waist of the exerciser along the left buttocks of the exerciser, continuously vertically downwardly along the back of the left thigh of the exerciser, to the back of the left knee of the exerciser, where it is selectively maintained thereagainst by said left knee engaging means.

8. The device as defined in claim 7, wherein said strap of said right member further extends continuously vertically downwardly from the back of the right knee of the exerciser, continuously vertically downwardly along the right calf of the exerciser, to the back of the right ankle of the exerciser; said strap of said left member further extends continuously vertically downwardly from the back of the left knee of the exerciser, continuously vertically downwardly along the left calf of the exerciser, to the back of the left ankle of the exerciser.

9. The device as defined in claim 8, wherein said strap of said right member further extends continuously vertically downwardly from the back of the right ankle of the exerciser, continuously vertically downwardly along the right heel of the exerciser, to said heel area of said right sole assembly, where another end thereof is fixedly attached thereto; said strap of said left member further extends continuously vertically downwardly from the back of the left ankle of the exerciser, continuously vertically downwardly along the left heel of the exerciser, to said heel area of said left sole assembly, where another end thereof is fixedly attached thereto.

10. The device as defined in claim 2, wherein said right knee engaging means includes an elastic sleeve that replaceably and snugly encircles the right knee of the exerciser; said elastic sleeve of said right knee engaging means has a front that is abuttable against the front of the right knee of the exerciser, and a back that is abuttable against the back of the right knee of the exerciser; said left knee engaging means includes an elastic sleeve that replaceably and snugly encircles the left knee of the exerciser; said elastic sleeve of said left knee engaging means has a front that is abuttable against the front portion of the left knee of the exerciser, and a back that is abuttable against the back of the left knee of the exerciser.

11. The device as defined in claim 10, wherein said front of said elastic sleeve of said right knee engaging means has a flap that is large and generally rectangular-shaped; said flap on said front of said elastic sleeve of said right knee engaging means is disposed over most thereof, so that additional protective cushioning is provided for the front of the right knee of the exerciser; said front portion of said elastic sleeve of said left knee engaging means has a flap that is large and generally rectangular-shaped; said flap on said front portion of said elastic sleeve of said left knee engaging means is disposed over most thereof, so that additional protective cushioning is provided for the front of the left knee of the exerciser.

12. The device as defined in claim 11, wherein said flap on said front of said elastic sleeve of said right knee engaging means has a first vertical edge that is fixedly attached to said front of said elastic sleeve of said right knee engaging means, and a second vertical edge that is spaced from, and opposes, said first vertical edge of said flap on said front portion of said elastic sleeve of said right knee engaging means; said second vertical edge of said flap on said front of said elastic sleeve of said right knee engaging means is releasibly maintained to said front of said elastic sleeve of said right knee engaging means by complementary portions of hook and loop fasteners; said flap on said front of said elastic sleeve of said left knee engaging means has a first vertical edge that is fixedly attached to said front of said elastic sleeve of said left knee engaging means, and a second vertical edge that is spaced from, and opposes, said first vertical edge of said flap on said front of said elastic sleeve of said left knee engaging means; said second vertical edge of said flap on said front of said elastic sleeve of said left knee engaging means is releasibly maintained to said front of said elastic sleeve of said left knee engaging means by complementary portions of hook and loop fasteners.

13. The device as defined in claim 12, wherein said flap on said front of said elastic sleeve of said right knee engaging means and said front of said elastic sleeve of said right knee engaging means define therebetween a space that releasibly, snugly, and vertically receives said strap of said right member that extends vertically along the front of the right knee of the exerciser, so that said strap of said right member can be selectively maintained against the front of the right knee of the exerciser by virtue of said complementary portions of hook and loop fasteners of said front of said elastic sleeve of said right knee engaging means; said flap on said front of said elastic sleeve of said left knee engaging means and said front of said elastic sleeve of said left knee engaging means define therebetween a space that releasibly, snugly, and vertically receives said strap of said left member that extends vertically along the front of the left knee of the exerciser, so that said strap of said left member can be selectively maintained against the front of the left knee of the exerciser by virtue of said complementary portions of hook and loop fasteners of said front of said elastic sleeve of said left knee engaging means.

14. The device as defined in claim 11, wherein said back of said elastic sleeve of said right knee engaging means has a flap that is small and generally rectangular-shaped; said flap on said back of said elastic sleeve of said right knee engaging means is disposed across an upper part thereof and is smaller than said flap on said front of said elastic sleeve of said right knee engaging means, so that said flap across said upper part of said back of said elastic sleeve of said right knee engaging means will not interfere with the back of the right knee of the exerciser when the right leg of the exerciser is flexed; said back of said elastic sleeve of said left knee engaging means has a flap that is small and generally rectangular-shaped; said flap on said back of said elastic sleeve of said left knee engaging means is disposed across an upper part thereof and is smaller than said flap on said front of said elastic sleeve of said left knee engaging means, so that said flap across said upper part of said back of said elastic sleeve of said left knee engaging means will not interfere with the back of the left knee of the exerciser when the left leg of the exerciser is flexed.

15. The device as defined in claim 14, wherein said flap on said back of said elastic sleeve of said right knee engaging means has a first vertical edge that is fixedly attached to said back of said elastic sleeve of said right knee engaging means, and a second vertical edge that is spaced from, and opposes, said first vertical edge of said flap on said back of said elastic sleeve of said right knee engaging means; said second vertical edge of said flap on said back of said elastic sleeve of said right knee engaging means is releasibly maintained to said back of said elastic sleeve of said right knee engaging means by complementary portions of hook and loop fasteners; said flap on said back of said elastic sleeve of said left knee engaging means has a first vertical edge that is fixedly attached to said back of said elastic sleeve of said left knee engaging means, and a second vertical edge that is spaced from, and opposes, said first vertical edge of said flap on said back of said elastic sleeve of said left knee engaging means; said second vertical edge of said flap on said back of said elastic sleeve of said left knee engaging means is releasibly maintained to said back of said elastic sleeve of said left knee engaging means by complementary portions of hook and loop fasteners.

16. The device as defined in claim 15, wherein said flap across said upper part of said back of said elastic sleeve of said right knee engaging means and said back of said elastic sleeve of said right knee engaging means define therebetween a space that releasibly, snugly, and vertically receives said strap of said right member that extends vertically along the back of the right knee of the exerciser, so that said strap of said right member can be selectively maintained against the back of the right knee of the exerciser by virtue of said complementary portions of hook and loop fasteners of said back of said elastic sleeve of said right knee engaging means; said flap on said back of said elastic sleeve of said left knee engaging means and said back of said elastic sleeve of said left knee engaging means define therebetween a space that releasibly, snugly, and vertically receives said strap of said left member that extends vertically along the back of the left knee of the exerciser, so that said strap of said left member can be selectively maintained against the back of the left knee of the exerciser by virtue of said complementary portions of hook and loop fasteners of said back of said elastic sleeve of said left knee engaging means.

17. The device as defined in claim 6, wherein said right waist engaging means and said left waist engaging means include a waist belt that adjustably and releasibly encircles the waist of the exerciser and overlaps and selectively maintains said strap of said right member and said strap of said left member against the waist of the exerciser, so that said strap of said right member and said strap of said left member can be selectively maintained against the waist of the exerciser.

18. The device as defined in claim 4, wherein said right shoulder engaging means includes a cushion that is rectangular-shaped and abuttable against the right shoulder of the exerciser, so that a cushion is provided between said strap of said right member and the right shoulder of the exerciser; said cushion of said right shoulder engaging means has an outer surface; said left shoulder engaging means includes a cushion that is rectangular-shaped and abuttable against the left shoulder of the exerciser, so that a cushion is provided between said strap of said left member and the left shoulder of the exerciser; said cushion of said right shoulder engaging means has an outer surface.

19. The device as defined in claim 18, wherein said outer surface of said cushion of said right shoulder engaging means has a flap that is rectangular-shaped and disposed over a part thereof; said flap on said outer surface of said cushion of said right shoulder engaging means has a first lateral edge that is fixedly attached to said outer surface of said cushion of said right shoulder engaging means, and a second lateral edge that is releasibly maintained to said outer surface of said cushion of said right shoulder engaging means, by complementary portions of hook and loop fasteners disposed thereon; said outer surface of said cushion of said left shoulder engaging means has a flap that is rectangular-shaped and disposed over a part thereof; said flap on said outer surface of said cushion of said left shoulder engaging means has a first lateral edge that is fixedly attached to said outer surface of said cushion of said left shoulder engaging means, and a second lateral edge that is releasibly maintained to said outer surface of said cushion of said left shoulder engaging means, by complementary portions of hook and loop fasteners disposed thereon.

20. The device as defined in claim 19, wherein said flap on said outer surface of said cushion of said right shoulder engaging means and said outer surface of said cushion of said right shoulder engaging means define therebetween a space that releasibly, snugly, and laterally receives said receives said strap of said right member that extends along the right shoulder of the exerciser, so that said strap of said right member can be selectively maintained against the right shoulder of the exerciser by virtue of said complementary portions of hook and loop fasteners of said right shoulder engaging means; said flap on said outer surface of said cushion of said left shoulder engaging means and said outer surface of said cushion of said left shoulder engaging means define therebetween a space that releasibly, snugly, and laterally receives said strap of said left member that extends along the left shoulder of the exerciser, so that said strap of said left member can be selectively maintained against the left shoulder of the exerciser by virtue of said complementary portions of hook and loop fasteners of said left shoulder engaging means.

21. The device as defined in claim 4; further comprising a front retaining strap being adjustable, releasible, and flexible; said front retaining strap releasibly encircling, and drawing together, said strap of said right member and said strap of said left member, at the chest of the exerciser, and being selectively maintained therearound by complementary portions of hook and loop fasteners disposed on free ends thereof.

22. The device as defined in claim 6; further comprising a back retaining strap being adjustable, releasible, and flexible; said back retaining strap releasibly encircling, and drawing together, said strap of said right member and said strap of said left member, at the back of the exerciser, and being selectively maintained therearound by complementary portions of hook and loop fasteners disposed on free ends thereof.

* * * * *